US005575470A

United States Patent [19]

Sherman

[11] Patent Number: 5,575,470

[45] Date of Patent: Nov. 19, 1996

[54] REMOVABLE BASKETBALL NETTING ASSEMBLY

[76] Inventor: David C. Sherman, 806 Greenway Dr., Coppell, Tex. 75019

[21] Appl. No.: 476,338

[22] Filed: Jun. 7, 1995

[51] Int. Cl.[6] ..... A63B 63/08

[52] U.S. Cl. ..... 273/1.5 R; 294/19.1

[58] Field of Search ..... 273/1.5 R, 1.5 A; 294/19.1, 24

[56] References Cited

U.S. PATENT DOCUMENTS

| | | | |
|---|---|---|---|
| 179,127 | 6/1876 | Norcross | 294/19.1 X |
| 3,595,573 | 7/1971 | Kilbourne | 273/1.5 R |
| 3,945,638 | 3/1976 | Luebkeman | 273/1.5 A |
| 4,805,903 | 2/1989 | McArdle | 273/1.5 R |
| 4,834,368 | 5/1989 | Qualley | 273/1.5 R |
| 4,877,241 | 10/1989 | Rothbard | 273/1.5 R |
| 4,903,964 | 2/1990 | Anderson | 273/1.5 R |
| 5,065,537 | 11/1991 | Bailey | 294/19.1 X |
| 5,098,091 | 3/1992 | McGivern | 273/1.5 R |
| 5,123,642 | 6/1992 | Stokes | 273/1.5 R |
| 5,156,394 | 10/1992 | Deal | 273/1.5 R |
| 5,195,742 | 3/1993 | Bailey | 273/1.5 R |
| 5,207,789 | 5/1993 | Gates | 273/1.5 A |
| 5,308,059 | 5/1994 | Owen, Jr. et al. | 273/1.5 R |
| 5,338,023 | 8/1994 | Stovall | 273/1.5 R |
| 5,360,208 | 11/1994 | Fang | 273/1.5 R |
| 5,379,666 | 1/1995 | Held | 294/19.1 X |
| 5,405,132 | 4/1995 | St. Onge | 273/1.5 R |

*Primary Examiner*—Paul E. Shapiro
*Attorney, Agent, or Firm*—Lisa L. B. Yociss

[57] ABSTRACT

A removable basketball netting assembly is disclosed for use with a basketball goal which includes a backboard, a rim, and a support ledge to secure; the rim to the backboard. The assembly includes a ring having a first portion and a second portion where the first portion has two opposing sides, a top, an interior surface, and at least one opening through the top of the first portion. The second portion includes a top, one side, and an interior surface. The first and second portions are removably engaged with the rim whereby the second portion accommodates the support ledge. A plurality of protrusions integral to the interior surface of the two sides are included for temporarily securing the ring to the rim. A plurality of cutouts through the ring are provided for receiving upper cords of a net so that the net depends from the ring. A placement device is utilized for engaging and disengaging the ring with the rim. The placement device includes a main body including a top, and a hook integral to the top of the main body.

10 Claims, 3 Drawing Sheets

REMOVABLE BASKETBALL NETTING ASSEMBLY

BACKGROUND OF THE INVENTION

1. Technical Field

The present invention relates to a removable basketball netting assembly, and in particular to a removable basketball netting assembly including a ring having an interior surface and a plurality of protrusions formed integrally on opposing sides of the interior surface. Still more particularly, the present invention relates to a removable basketball netting assembly including a ring having an interior surface and a plurality of protrusions formed integrally on opposing sides of the interior surface, and including a placement device for securing and removing the basketball netting assembly to a conventional basketball goal.

2. Description of the Related Art

In order to properly play the game of basketball, a net is required. Often times the net is missing from basketball goals found in public parks and school yards where a basketball player might desire to play basketball. Several attempts have been made to provide a removable fixture which includes a net.

U.S. Pat. No. 4,805,903 issued to McArdle describes a fixture which includes a main body, a net removably received on the main body, and a boat hook for installing and removing the main body from a basketball hoop. The main body includes a bottom skirt integrally attached to an arcuate lip. The skirt is received within the confines of the hoop. Equally spaced cut-outs are provided through the skirt for attaching a net. A magnetic strip is secured to the main body for magnetically adhering the main body to the hoop. An opening is provided through the lip to receive the spike of the boat hook. In order to remove the fixture from the hoop, the boat hook is placed under the main body and against the skirt. The hook is pushed upward causing the magnetic strip to be released, and thus dislodging the fixture. The spike of the boat hook is then removed from the skirt and placed in the opening in order to lift and lower the fixture.

Another attempt to solve the problem is described in U.S. Pat. No. 4,903,964 issued to Anderson which describes a netting, an annular member which includes a C-shaped rim-engaging portion disposed in pressfit engagement with the rim, means for attaching the net to the annular member, and a horizontal support extending radially outwardly from the rim-engaging portion. Tabs are provided on the rim-engaging portion projecting in an outward radial direction to facilitate engagement. A lifting tool is provided which includes a horizontal arm terminating in a downwardly projecting lug and a grooved portion. In order to lift the member, the member is positioned in the groove and then raised to the rim. To remove the member, the upper surface of the horizontal arm is engaged with the tab. The tool is then lifted until the rim-engaging portion is released. The tool is removed from the rim-engaging portion and the underside of the arm is then hooked over the rim-engaging portion to pull the member through the middle of the hoop.

SUMMARY OF THE INVENTION

A removable basketball netting assembly is disclosed for use with a basketball goal which includes a backboard, a rim, and a support ledge to secure the rim to the backboard, The assembly includes a ring having a first portion and a second portion where the first portion has two opposing sides, a top, an interior surface, and at least one opening through the top of the first portion. The second portion includes a top, one side, and an interior surface. The first and second portions are removably engaged with the rim whereby the second portion accommodates the support ledge. A plurality of protrusions integral to the interior surface of the two sides are included for temporarily securing the ring to the rim. A plurality of cutouts through the ring are provided for receiving upper cords of a net so that the net depends from the ring. A placement device is utilized for engaging and disengaging the ring with the rim. The placement device includes a main body including a top, and a hook integral to the top of the main body.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
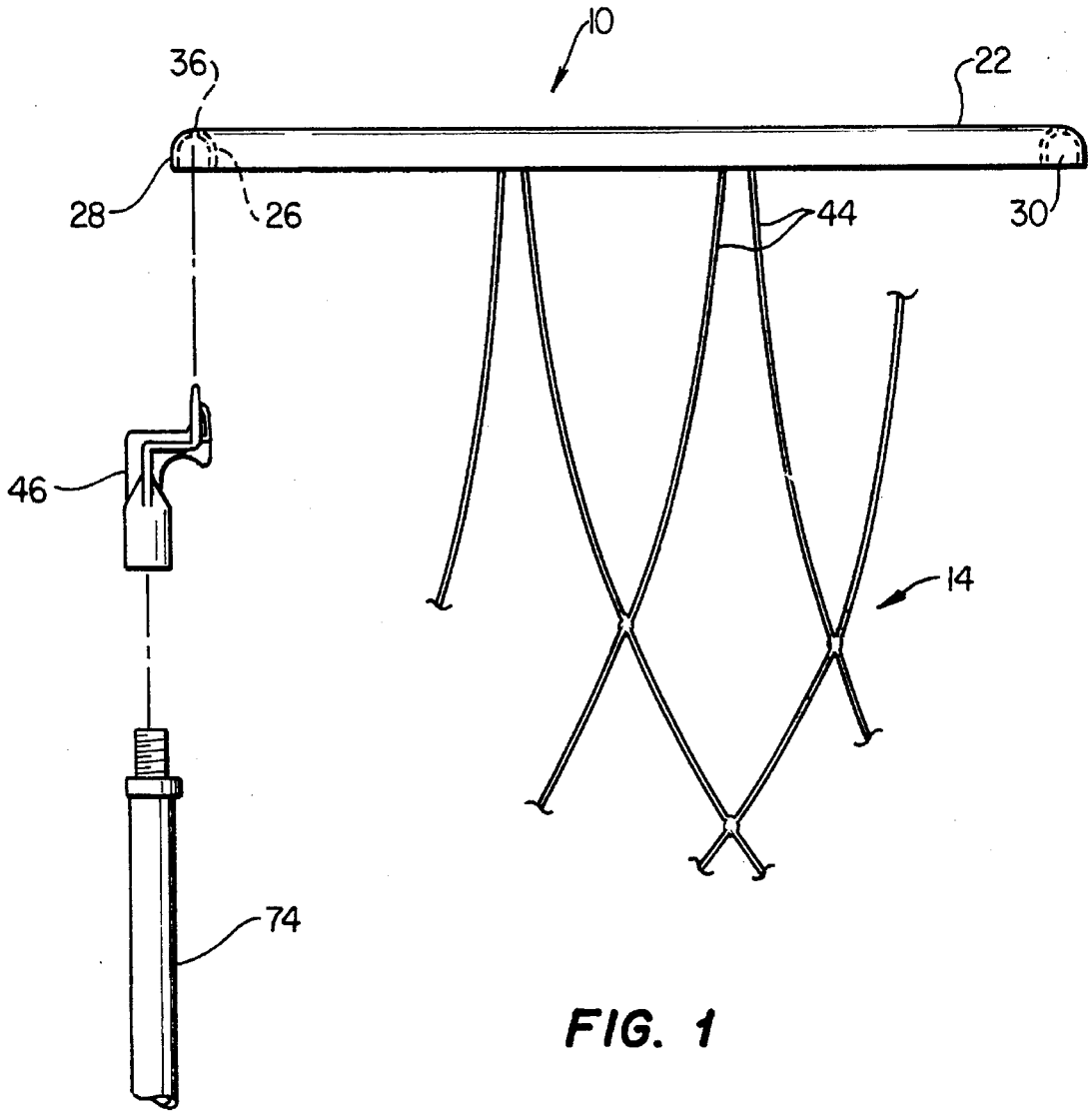
FIG. 1 is a side view of a basketball netting assembly and placement device in accordance with the present invention.
Figure 5:
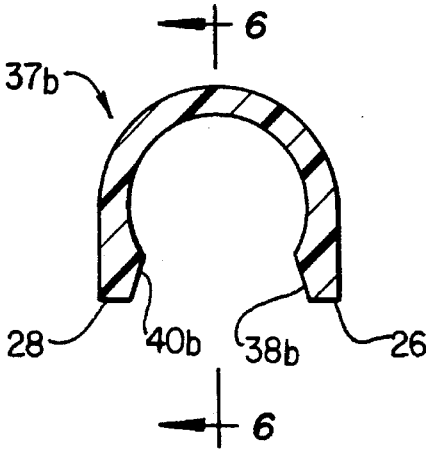
FIG. 5 is a side sectional view of a first and a second protrusion included within a basketball netting assembly taken along line 5—5 shown in FIG. 2 in accordance with the present invention.
Figure 6:
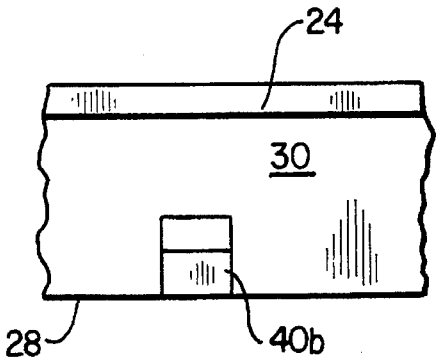
FIG. 6 is a side view of a first protrusion included within a basketball netting assembly taken along line 6—6 shown in FIG. 5 in accordance with the present invention.
Figure 2:
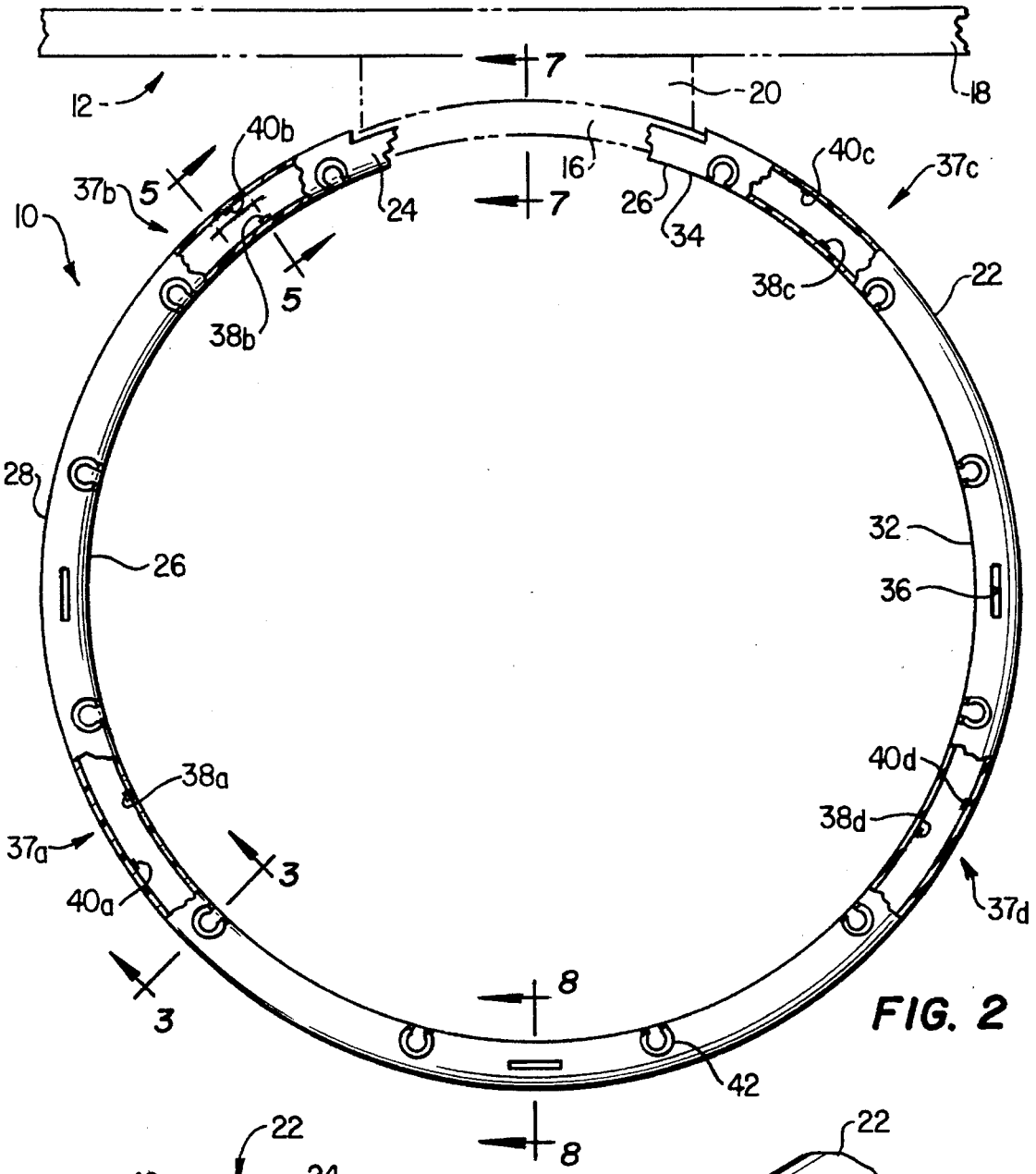
FIG. 2 is a top view of a basketball netting assembly releasably secured to a basketball goal in accordance with the present invention.
Figure 3:
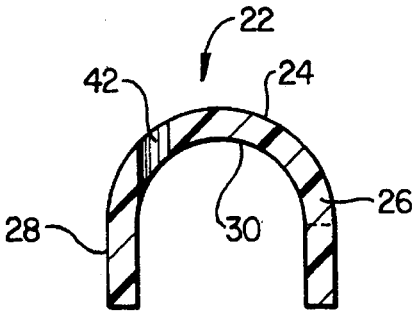
FIG. 3 is a side sectional view of a cutout included within a basketball netting assembly taken along line 3—3 shown in FIG. 2 in accordance with the present invention.
Figure 4:
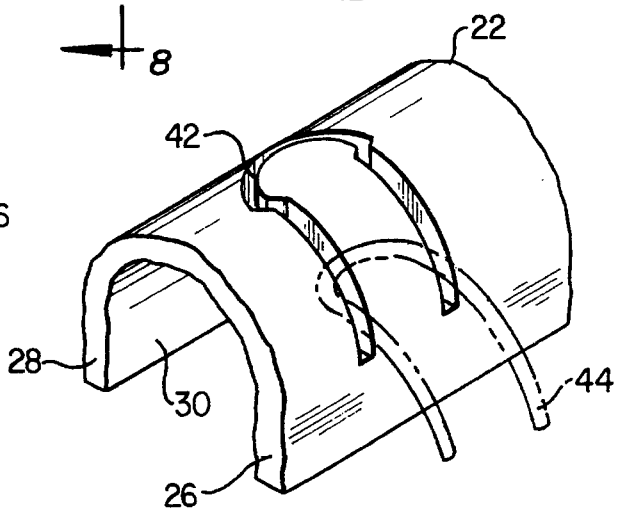
FIG. 4 is a perspective view of a cutout included within a basketball netting assembly and upper cords of a net secured within the cutout in accordance with the present invention.
Figure 7:
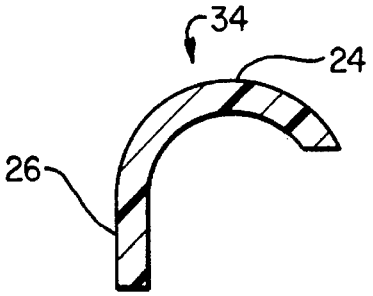
FIG. 7 is a side sectional view of a top and a side of a ring included within a basketball netting assembly taken along line 7—7 shown in FIG. 2 in accordance with the present invention.
Figure 8:
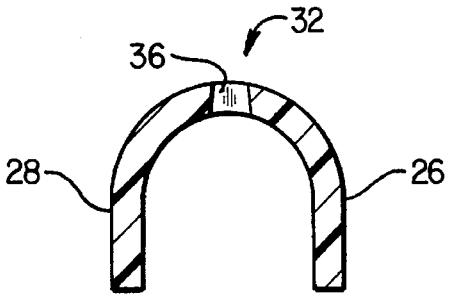
FIG. 8 is a side sectional view of an opening through a ring included within a basketball netting assembly taken along line 8—8 shown in FIG. 2 in accordance with the present invention.
Figure 10:
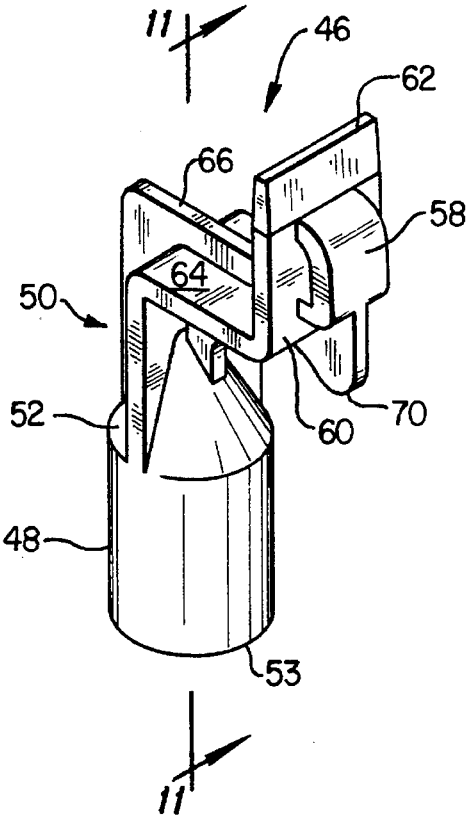
FIG. 10 is a perspective view of a placement device included within a basketball netting assembly in accordance with the present invention.
Figure 9:
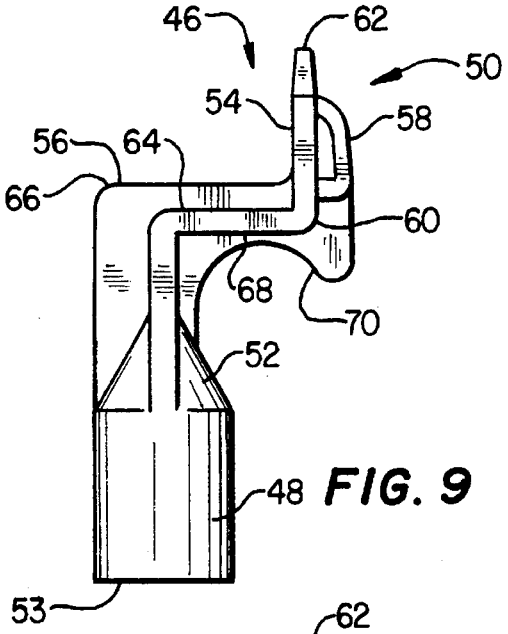
FIG. 9 is a side view of a placement device included within a basketball netting assembly in accordance with the present invention.
Figure 11:
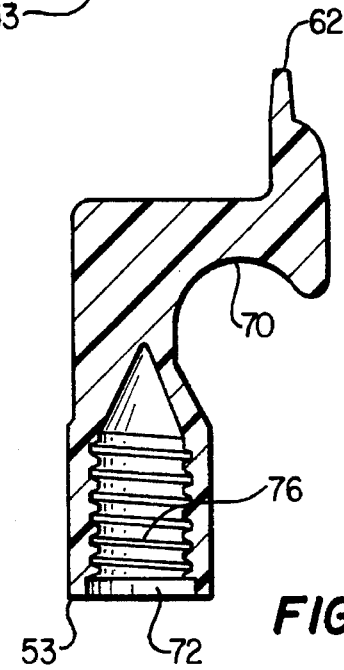
FIG. 11 is a side section view of a placement device included within a basketball netting assembly taken along line 11—11 shown in FIG. 10 in accordance with the present invention.

With reference now to the figures, FIG. 1 is a side view of a basketball netting assembly and placement device in accordance with the present invention. FIG. 2 is a top view of a basketball netting assembly releasably secured to a basketball goal in accordance with the present invention. FIG. 3 is a side sectional view of a cutout included within a basketball netting assembly taken along line 3—3 shown in FIG. 2 in accordance with the present invention. FIG. 4 is a perspective view of a cutout included within a basketball netting assembly and upper cords of a net secured within the cutout in accordance with the present invention. FIG. 5 is a side sectional view of a first and a second protrusion included within a basketball netting assembly taken along line 5—5 shown in FIG. 2 in accordance with the present invention. FIG. 6 is a side view of a first protrusion included within a basketball netting assembly taken along line 6—6 shown in FIG. 5 in accordance with the present invention. FIG. 7 is a side sectional view of a top and a side of a ring included within a basketball netting assembly taken along line 7—7 shown in FIG. 2 in accordance with the present invention. FIG. 8 is a side sectional view of an opening through a ring included within a basketball netting assembly taken along line 8—8 shown in FIG. 2 in accordance with the present invention. FIG. 9 is a side view of a placement device included within a basketball netting assembly in accordance with the present invention. FIG. 10 is a perspective view of a placement device included within a basketball netting assembly in accordance with the present invention. FIG. 11 is a side section view of a placement device included within a basketball netting assembly taken along line 11—11 shown in FIG. 10 in accordance with the present invention.

In order to properly play the game of basketball, a net is required. Often times the net is missing from basketball goals found in public parks and school yards where a basketball player might desire to play basketball. Basketball netting assembly 10 may be utilized by a player when a basketball goal 12 does not include a net 14. Basketball netting assembly 10 may be removably secured to a rim 16 of basketball goal 12. Rim 16 is secured to a backboard 18 utilizing a support ledge 20. In this manner, a player may always play basketball utilizing a net 14.

Basketball netting assembly 10 includes a ring 22 having an inverted U-shaped cross-section as depicted in FIGS. 3, 6, and 8. Ring 22 is preferably formed from a resilient material such as plastic. Ring 22 includes a top 24, opposing interior and exterior sides 26 and 28, respectively, and an interior surface 30. When in use, ring 22 is engaged with rim 16 so that top 34 and opposing sides 26, 28 of ring 22 rest against rim 16. Ring 22 includes a first portion 32 and a second portion 34. Second portion 34 of ring 22 includes only side 26 and top 24 to accommodate support ledge 20 so that when in use, only top 24 and side 26 of second portion 34 are engaged with rim 22. At least one generally rectangular opening 36 is included through top 24 of ring 22. Opening 36 is utilized during the placement and removal of ring 22.

Ring 22 includes a plurality of pairs 37*a*, 37*b*, 37*c*, and 37*d* of protrusions on interior surface 30. Pair 37*a* includes protrusions 38*a*, 40*a*. Pair 37*b* includes protrusions 38*b*, 40*h*. Pair 37*c* includes protrusions 38*c*, 40*c*. Pair 37*d* includes protrusions 38*d*, 40*d*. Protrusions 38*a*, 38*b*, 38*c*, and 38*d* are formed integrally an side 26. Protrusions 40*a*, 40*h*, 40*c*, and 40*d* are formed integrally on side 28. Each of the protrusions included within a pair are in closely spaced relation with each other. For example, protrusions 38*a* and 40*a* are located in closely spaced relation with each other. Each protrusion has a generally rectangular front and a generally triangular cross-section. The plurality of pairs 37*a*, 37*b*, 37*c*, and 37*d* of protrusions are utilized to hold ring 22 securely in place when ring 22 is in use. Each protrusion within pairs 37*a*, 37*b*, 37*c*, 37*d* is engaged with and grasps rim 16, thus keeping ring 22 engaged with rim 16.

A plurality of inverted, generally U-shaped cutouts 42 are spaced circumferentially around ring 22 to receive upper cords 44 of net 14. Once upper cords 44 are received within cutouts 42, net 14 depends from ring 22. Cutouts 42 are preferably formed primarily through side 26 and top 24 of ring 22. In this manner, upper cords 44 of net 14 may be inserted in cutouts 42 so that when ring 22 is engaged with rim 16, net 14 is received within and falls below rim 16 so that a player may play basketball with a net 14.

A placement device 46 may be utilized to secure and remove the basketball netting assembly 10 to a conventional basketball goal 12. Placement device 46 includes a main body 48 and a generally L-shaped hook 50 formed integrally on a top 52 of main body 48. Main body includes bottom 53. Hook 50 includes a vertical section 54, a horizontal section 56, and a vertical protrusion 58 protruding from a front 60 of vertical section 54. Vertical section 54 has a generally rectangular cross-section and a top 62 for inserting into and engaging opening 36. Horizontal section 56 includes a top 64 having a ridge 66, and a bottom 68 having a ridge 70 to provide additional support for hook 50 when placement device 46 is in use. Ridge 70 generally has an inverted U-shape. Main body 48 includes a threaded cavity 72 in said bottom 53 for receiving a handle 74, such as a wooden broom handle. Those skilled in the art will recognize that any type of handle may be utilized such as an ordinary broom handle or a specially adapted handle, such as shown in FIG. 1. The threads 76 facilitate insertion and holding of handle 74.

In order to utilize basketball netting assembly 10, a user first secures net 14 to ring 22 by inserting upper cords 44 into cutouts 42. Ring 22 may then be lifted to rim 16 by first inserting top 62 of vertical section 54 of placement device 46 into one off, openings 36. Ring 22 is lifted above rim 16 so that net 14 may be received within rim 16. The ring 22 is then lowered and placed on rim 16. Placement device 46 is removed from opening 36. Ridge 70 on bottom 68 of horizontal section 56 is placed on top 24 of ring 22. A user may then temporarily secure ring 22 to rim 16 by pulling placement device 46 downward! sliding opposing sides 26,28 of ring 22 rim 16 causing each protrusion to temporarily be displaced while each protrusion slides around rim 16. Once ring 22 is engaged with rim 16, each protrusion will regain its original shape, thus holding ring 22 in place. A player may then utilize basketball netting assembly 10.

When a player is ready to remove basketball netting assembly 10, a player may tilt placement device 46 and insert top 62 of vertical section 54 of placement device 46 between side 28 of ring 22 and rim 16. A player may then slide top 62 of vertical section 54 into opening 36 by placing vertical protrusion 58 against rim 16, causing placement device 46 to be tilted back into an upright position, thus urging ring 22 away from rim 16. Top 62 is then slid up and into opening 36. Each protrusion is temporarily deformed to permit ring 22 to be disengaged from rim 16. A player may then lift placement device 46 causing ring 22 to be completely removed and raised above rim 16 so that net 14 is also raised above rim 16. Once ring 22 is disengaged from rim 16, each protrusion regains its original shape. Ring 22 may then be lowered from basketball goal 12 by lowering placement device 46. Top 62 of vertical section 54 may then be removed from opening 36.

Basketball netting assembly 10 offers many advantages over the prior art. Basketball netting assembly 10 fits easily over rim 16. By providing a plurality of pairs of protrusions, ring 22 may be secured to rim 16 during use while permitting a user to easily secure ring 22 to rim 16 and to remove ring 22. This design does not require a user to precisely place assembly 10 on rim 16 and then pressfit the entire interior surface of the ring to rim 16.

Placement device 46 also offers significant advantages, particularly in combination with ring 22. Placement device 46 does not include any dangerous tips which must be utilized to secure and remove the ring. Placement device 46 may be utilized by a user to raise ring 22 to basketball goal 12 and lower ring 22 onto rim 16. In order to remove ring 22, a user may utilize one continuous, uninterrupted movement by inserting top 62 between ring 22 and rim 16, causing the protrusions 38*a*, 38*b*, 40*a*, and 40*b* to be released from rim 16 by pressing vertical protrusion 58 against rim 16, lifting ring 22 and net 14 above rim 16, and then lowering placement device 46 and ring 22. Only one continuous movement is required when utilizing assembly 10. Unlike the prior art, the user does not need to first disengage ring, remove placement device from ring, reinsert placement device into or under ring, and then lower ring.

While the invention has been particularly shown and described with reference to a preferred embodiment, it will be understood by those skilled in the art that various changes in form and detail may be made therein without departing from the spirit and scope of the invention.

What is claimed is:

1. A removable basketball netting assembly for use with a basketball goal including a backboard, a rim, and a support ledge to secure said rim to said backboard, comprising:

a ring having an inverted U-shaped cross-section and including a first portion and a second portion, said first portion having two opposing sides, a top, an interior surface extending only from a first of said two opposing sides through said top and to a second of said two opposing sides, and at least one generally rectangular opening through said top of said first portion of said ring, said second portion having one side, a top, and an interior surface, wherein said first and said second portion are removably engaged with said rim and wherein said second portion accommodates said support ledge, further wherein said two opposing sides extend only slightly below said rim when said ring is engaged with said rim;

a plurality of protrusions, each of said plurality of protrusions spaced apart from all others of said plurality of protrusions and formed alternatively on said interior surface on said first of said two opposing sides and said interior surface on said second of said two opposing sides, said plurality of protrusions being staggered around said ring, so that none of said plurality of protrusions are located directly across from any of said plurality of protrusions for temporarily securing said ring to said rim; and a placement device having a main body for receiving a handle and including a top of said main body, a hook having a horizontal section and a vertical section, said horizontal section having a top, a bottom, a first end, and a second end, wherein said bottom of said first end of said horizontal section is formed on said top of said main body, said vertical section having a top and a bottom, said bottom of said vertical section formed on said top of said second end of said horizontal section said vertical section including a front on which a vertical protrusion is formed, said vertical protrusion extending only along a portion of said front of said vertical section, wherein said portion, does not extend from said top to said bottom of said vertical section, said top of said vertical section being received within said opening of said ring.

2. The basketball netting assembly according to claim 1 wherein said hook further includes a ridge on a bottom of said horizontal section for engagement with said top of said ring to removably engage said ring with said rim.

3. The basketball netting assembly according to claim 2 wherein said ridge generally an inverted U-shape.

4. The basketball netting assembly according to claim 3 wherein main body includes a bottom.

5. The basketball netting assembly according to claim 4 wherein said main body includes a cavity for receiving an elongate handle.

6. The basketball netting assembly according to claim 5 where said cavity in included in said bottom of said main body.

7. The basketball netting assembly according to claim 6 wherein said cavity is threaded for facilitating receipt of said handle.

8. The basketball netting assembly according to claim 1 further comprising a cavity formed between said vertical protrusion and said front of said vertical section.

9. A method for temporarily securing a basketball netting assembly to a basketball goal and for removing said basketball netting assembly from said basketball goal, said basketball goal including a backboard, a rim, and a support ledge, comprising the steps of:

inserting a top of a vertical section of a placement device into one of a plurality of openings through a top of said ring, wherein said placement device includes a main body including a top of said main body, a hook having a horizontal section and a vertical section, said horizontal section having a first end and a second end, wherein said first end of said horizontal section is formed on said top of said main body, said vertical section having a top and a bottom, said bottom of said vertical section formed on said second end of said horizontal section, said vertical section including a front on which a vertical protrusion is formed, said vertical protrusion extending only along a portion of said front of said vertical section, wherein said portion does not extend from said top to said bottom of said vertical section;

lifting said ring over said rim, wherein said ring includes an inverted U-shaped cross-section and including a first portion and a second portion, said first portion having two opposing sides, said top, an interior surface extending only from a first of said two opposing sides through said top and to a second of said two opposing sides, and at least one generally rectangular opening through said top of said first portion of said ring, said second portion having one side, a top, and an interior surface, wherein said first and said second portion are removably engaged with said rim and wherein said second portion accommodates said support ledge;

lowering said ring onto said rim;

removing said placement device from said ring;

placing a bottom of said horizontal section of said placement device on said top of said ring; and temporarily securing said ring onto said rim, by pulling said placement device down, wherein a plurality of protrusions are temporarily deformed while said ring is being secured onto said rim, each of said plurality of protrusions formed alternatively on said interior surface on said first of said two opposing sides and said interior surface on said second of said two opposing sides, each of said plurality of protrusions being staggered around said ring, so that none of said plurality of protrusions are located directly across from any of said plurality of protrusions, said plurality of protrusions regaining an original shape of said plurality of protrusions when said ring is temporarily secured to said rim, wherein said first and said second sides of said ring are secured around said rim.

10. The method according to claim 9, further comprising the steps of:

inserting said top of said vertical section between one of said two opposing sides of said ring and said rim;

placing said vertical protrusion against said rim;

tilting said placement device into an upright vertical position, whereby said ring is moved away from said rim;

sliding said top of said vertical section into one of said plurality of openings through said top of said ring;

pushing said placement device up so that said plurality of protrusions are temporarily deformed, thus permitting said ring to be disengaged from said rim;

lifting said ring above and horizontally away from said rim by lifting and moving said placement device; and lowering said placement device and said ring, wherein a user may remove said ring from said placement device.

* * * * *

UNITED STATES PATENT AND TRADEMARK OFFICE

CERTIFICATE OF CORRECTION

PATENT NO. : 5,575,470
DATED : November 19, 1996
INVENTOR(S) : David C. Sherman

It is certified that error appears in the above-indentified patent and that said Letters Patent is hereby corrected as shown below:

IN THE ABSTRACT:

Line 3: "secure; the rim" should be "secure the rim".

IN COLUMN:

Column 3, line 58: "40h" should be "40b"

Column 3, line 61: "40h" should be "40b"

Signed and Sealed this

Fourth Day of November, 1997

*Attest:*

*Attesting Officer*

BRUCE LEHMAN

*Commissioner of Patents and Trademarks*